United States Patent [19]

McIntyre et al.

[11] Patent Number: 4,678,186

[45] Date of Patent: Jul. 7, 1987

[54] PELVIC RESTRAINT FOR EXERCISE APPARATUS

[75] Inventors: Donald R. McIntyre, Chapel Hill; James E. Miles, Graham, both of N.C.

[73] Assignee: Isotechnologies, Inc., Hillsborough, N.C.

[21] Appl. No.: 820,719

[22] Filed: Jan. 17, 1986

[51] Int. Cl.[4] ..... A63B 21/00

[52] U.S. Cl. ..... 272/134; 272/143; 128/134

[58] Field of Search ..... 128/78, 33, 133, 134, 128/68-75; 272/134, 118, 143; 297/216, 416, 411, 353

[56] References Cited

U.S. PATENT DOCUMENTS

| | | | |
|---|---|---|---|
| 30,601 | 11/1860 | Wright | 128/78 |
| 3,889,664 | 6/1975 | Heuser et al. | 128/78 X |
| 4,030,489 | 6/1977 | Buckner | 128/75 |

FOREIGN PATENT DOCUMENTS

| | | | |
|---|---|---|---|
| 2363390 | 6/1975 | Fed. Rep. of Germany | 128/75 |
| 926434 | 4/1947 | France | 128/75 |
| 40936 | 6/1958 | Poland | 128/75 |

*Primary Examiner*—Richard J. Apley
*Assistant Examiner*—James Prizant
*Attorney, Agent, or Firm*—Richard E. Jenkins

[57] ABSTRACT

An improved pelvic restraint is provided for use in association with an exercise apparatus which is most suitably a low back exercise apparatus. The pelvic restraint comprises a seat having laterally adjustable hip restraints provided with a belt for extending therebetween across the abdomen of a user. An adjustable back restraint is also provided for engagement with the lower back. In this fashion, the pelvic restraint prevents lifting or lateral shifting of the hips and forward or rearward pitching of the pelvic area so that more accurate evaluation may be conducted on an exercise apparatus to which the pelvic restraint is secured.

12 Claims, 5 Drawing Figures

PELVIC RESTRAINT FOR EXERCISE APPARATUS

DESCRIPTION

Copending with application Ser. No. 06/820718 filed 1-17-86, now U.S. Pat. No. 4,653,750.

TECHNICAL FIELD

This invention relates to an improved pelvic restraint for use in combination with an exercise machine whereby the pelvis is provided with improved lateral and front to back restraint so that movement relative to the pelvic restraint is minimized. The pelvic restraint is particularly adapted for use in combination with a low back exercise machine of the type wherein the user is supported in an upright or sitting position and exercises against a resistance while doing exercises including rotation, flexion and extension, and lateral flexion. The exercise apparatus is most suitably of the type utilized in diagnostic and rehabilitative exercise and which may be provided with an associated computer in order to analyze selected movements by the user.

BACKGROUND ART

The pelvic restraint of the present invention is an improvement over previous pelvic restraint devices utilized in exercise apparatus, particularly low back exercise apparatus, since it more securely restrains the pelvis therein and minimizes movement of the pelvis relative to the restraint device. This results in improved repeatability and accuracy of data relating to back movement generated by a low back exercise apparatus. Previous pelvic restraints have allowed for lifting of one or both hips, lateral movement of the hips, and forward and rearward pitching of the pelvis due to the lack of proper restraint. Moreover, the pelvic restraint of the present invention accommodates a larger range of buttocks than has been possible with previous pelvic restraints. Prior pelvic restraints known to the applicant are generally comprised of a padded seat and back and have a belt secured at each end thereof to a support fixedly attached to the seat back. As noted above, this type of pelvic restraint structure allows for unacceptable hip movement relative to the restraint in view of its inherent inadequate stabilization of the pelvis in relation to the restraint.

DISCLOSURE OF THE INVENTION

The pelvic restraint of the instant invention provides for an improved pelvic restraint for use in combination with an exercise machine, most suitably a low back exercise apparatus of the type wherein the user is restrained in an upstanding or sitting position and moves against a resistance while performing certain back exercises including rotation, flexion and extension, and lateral flexion movements. The pelvic restraint is so designed as to substantially miminize movement of the pelvis relative to the restraint and the associated exercise apparatus so that repeatable and accurate results can be obtained during measurement of low back exercise.

The pelvic restraint of the instant invention comprises a seat having an adjustable upwardly extending back portion with a lower back engaging resilient pad positioned at the top thereof. This allows for accommodation of a wide range of sizes of buttocks and reduces rearward pivoting of the pelvis during exercise. It also allows for correct alignment of the exercise apparatus axes with the axis of the spine. A pair of laterally adjustable and inwardly inclined side restraints are used to firmly engage the hips in a locked position so that they may not be lifted relative to the seat during exercise. A hip restraint belt extends between the side restraints to better control forward pivoting of the hips during exercise. The attachment points for the restraint belt are preferably so located on the side restraints as to give maximum securement of the back of the user to better prevent forward rotation of the hips during the exercise. Finally, padding is provided but minimized on the pelvic restraint of the invention since it has been found that thick padding contributes to relative movement of the hips or pelvis within a pelvic restraint during low back exercise movements.

Therefore, it is an object of the present invention to provide an improved pelvic restraint for use with a low back exercise apparatus in order to minimize hip movement during the performance of low back exercises.

It is a more specific object of the present invention to provide an improved pelvic restraint so as to improve the accuracy and repeatability of data generated on a low back exercise apparatus of the type utilizing a computer for analysis of certain back movements.

BRIEF DESCRIPTION OF THE DRAWINGS

Some of the objects of the invention having been stated, other objects will become evident as the description proceeds, when taken in connection with the accompanying drawings, in which.

BEST MODE FOR CARRYING OUT THE INVENTION

Figure 1:
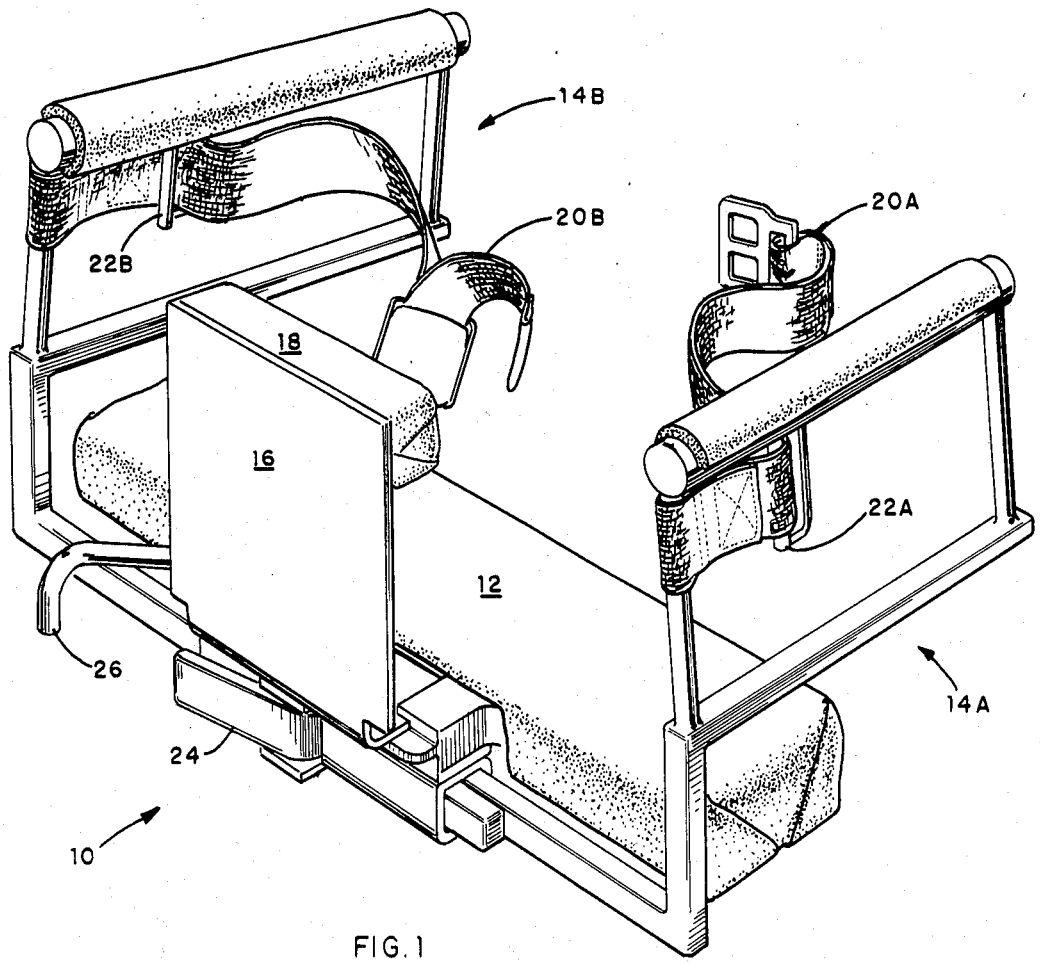
FIG. 1 is a rear perspective view of the pelvic restraint of the instant invention.
Figure 1A:
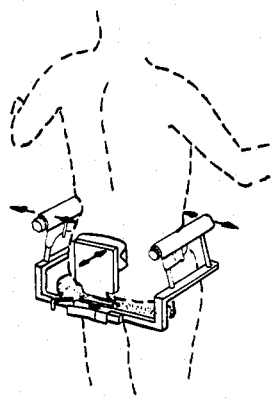
FIG. 1A is a reduced size rear perspective view of a user (in phantom lines) in an upstanding position in the pelvic restraint of the instant invention.
Figure 1B:
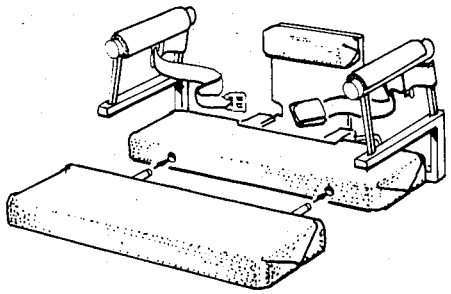
FIG. 1B is a reduced size front perspective view of the pelvic restraint of the instant invention further including an optional seat extender.

Referring now more specifically to the drawings, a preferred embodiment of a pelvic restraint according to the present invention is shown in FIG. 1 and generally designated 10. Pelvic restraint 10 comprises a seat 12 and laterally adjustable hip restraints 14A, 14B. An adjustable back restraint 16 includes a resilient pad 18 for low back engagement. A restraint belt 20A, 20B is threaded through slidable guides 22A, 22B and attached to the rear posts of hip restraints 14A, 14B. FIG. 1A depicts an upstanding user secured to pelvic restraint 10. FIG. 1B depicts an optional seat extension for use, if desired, for a user in the sitting position.

Figure 2:
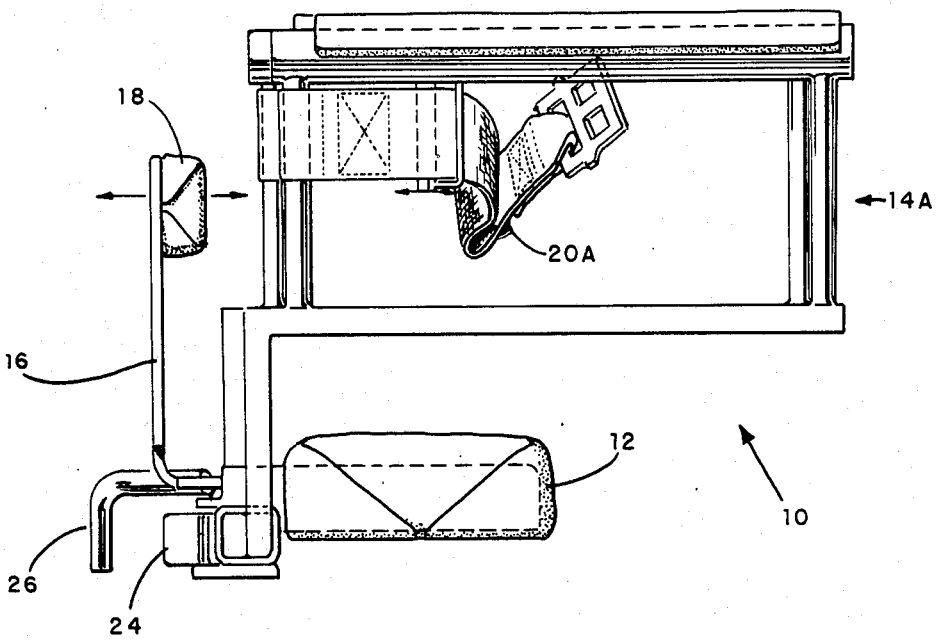
FIG. 2 is a side elevation view of the pelvic restraint of the instant invention.
Figure 3:
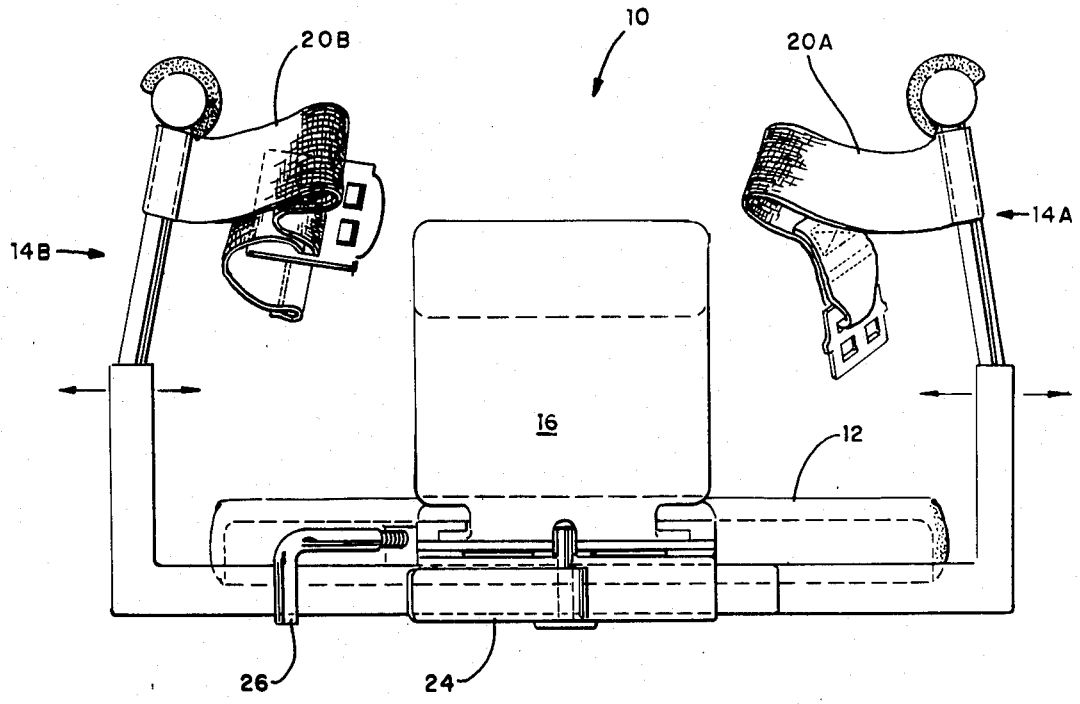
FIG. 3 is a rear elevation of the pelvic restraint of the instant invention.

As can be clearly observed with reference to FIGS. 2 and 3, hip restraints 14A, 14B are inwardly inclined about 10 degrees and may be laterally adjusted so as to best accommodate the buttocks of a user. Restraints 14A, 14B are then locked into position with lock 24 at the rear of pelvic restraint 10 which may most suitably be a pawl-type lock. Back restraint 16 is slidably received by seat 12 and horizontally adjustable toward and away from seat 12 so as to accommodate the buttocks and lower back of the user. Back restraint 16 is locked into position with back restraint lock 26 which is most suitably of the conventional set screw type which threadingly engages seat 12 so as to come into contact with the horizontal slide of back restraint 16, although any suitable locking means may be utilized. Belt restraint 20A, 20B comprises a conventional belt strap and buckle as depicted in the drawings. As noted hereinbefore, belt restraint 20A, 20B is secured to guides 22A, 22B carried by respective hip restraints 14A, 14B which each define a slot (not shown) in the top bar element thereof for the posts to be horizontally adjusted to accommodate the user. It should be appreciated that guides 22A, 22B are positioned on hip restraints 14A, 14B so that maximum control may be achieved over forward rotation or pivoting of the hips when belt restraint 20A, 20B is secured across the abdomen of a person positioned in pelvic restraint 10.

The improved hip restraint is intended for use in combination with a suitable low back exercise machine so as to maximize restraint of the pelvic area in order to improve testing and data generated by testing of low back movement in all three axes. The three axes of movement contemplated include rotational movement, flexion and extension movement, and lateral flexion movement. While prior known pelvic restraints permitted undesirable lifting and lateral movement of the hips and rearward pitching of the pelvis, pelvic restraint 10 is constructed so as to prevent any significant forward or rearward pitching of the pelvis, lifting of either one or both hips or lateral movement of the hips of the user of a low back exercise apparatus.

In operation, an individual to be evaluated on a low back exercise machine is placed in an upstanding or sitting position in contact with pelvic restraint 10. The user's buttocks are positioned onto seat 12 and hip restraints 14A, 14B are laterally adjusted and locked so as to snugly engage the user's pelvis in order to limit both lateral and upward hip displacement. Back restraint 16 is slidably adjusted so that pad 18 comes into restraining contact with the sacral area of the low back of the user and then locked in this position with lock 26 in order to restrict rearward pitch of the pelvis and to accommodate the buttocks of the user. Next, belt restraint 20A, 20B is snugly secured around the abdomen of the user in order to restrain the pelvis in an upright position and prevent forward rotation during testing. Padding on user contact areas of pelvic restraint 10 is minimized since it has been found that thick padding allows for unacceptable shifting of the pelvis relative to pelvis restraint 10 due to its compressibility. It will thus be seen that there has been described above an improved pelvic restraint for use with exercise apparatus and most suitably a low back exercise apparatus wherein accurate testing requires that the pelvic area of the person being tested should not shift relative to the pelvic restraint and associated exercise apparatus.

While the instant invention has been shown and described herein in what is conceived to be the most practical and preferred embodiment, it is recognized that departures may be made therefrom within the scope of the invention, which is therefore not to be limited to the details disclosed herein but is to be accorded the full scope of the claims so as to embrace any and all equivalent apparatus.

What is claimed is:

1. A pelvic restraint adapted for use with a back exercise machine of the type wherein the user is secured thereto in an upstanding or sitting position and comprising:

seat means for accommodating at least a portion the buttocks of a user;

a pair of laterally spaced-apart hip restraint means associated with said seat means for restraining hip movement, said pair of restraint means extending generally upwardly from said seat means and in converging relationship to each other so as to snugly engage the hips of the user;

strap restraint means secured to said pair of hip restraint means and extending therebetween for restraining forward movement of the pelvis of the user;

back restraint means associated with said back means for snugly engaging the low back of the user in order to restrain rearward movement of the pelvis; and means for coupling said pelvic restraint to a low back exercise machine;

whereby movement of the pelvis of the user relative to the pelvic restraint is minimized during exercise of the back.

2. A pelvic restraint according to claim 1 wherein said hip restraint means are laterally adjustable.

3. A pelvic restraint according to claim 1 wherein said back restraint means comprises an upstanding support adjacent the rear of said seat means having a resilient pad affixed to the upper end thereof for engagement of the sacral area of the low back of the user.

4. A pelvic restraint according to claim 3 wherein said back restraint means is adjustable relative to said seat means both toward and away from the back of the user.

5. A pelvic restraint according to claim 1 wherein said pair of hip restraint means each comprises a plurality of spaced-apart substantially vertically extending bars having a plurality of horizontally extending bars therebetween, said restraint means defining two planes each inclined about 10 degrees inwardly from vertical so as to define converging planes.

6. A pelvic restraint according to claim 1 wherein said seat means comprises an elongate laterally extending surface having a width sufficient to accommodate the user's buttocks and a depth sufficient to accommodate the user's buttocks.

7. A pelvic restraint according to claim 1 wherein said seat means, hip restraint means and back restraint means are padded.

8. In combination with a back exercise machine particularly adapted for providing resistance to movement by the user, a pelvic restraint comprising:

seat means for accommodating at least a portion of the buttocks of the upstanding user;

a pair of laterally spaced-apart hip restraint means adjustably engaging said seat means for restraining hip movement, said pair of restraint means extending generally upwardly from said seat means and in converging relationship to each other so as to engage the hips of the user;

strap restraint means secured to said pair of hip restraint means and extending therebetween for restraining forward movement of the pelvis of the user;

back restraint means adjustably engaging said seat means for engaging the low back of the user to restrain rearward movement of the pelvis; and means for coupling said pelvis restrain device to a back exercise machine.

9. The combination according to claim 8 wherein said back restraint means comprises an upstanding support adjacent the rear of said seat means having a resilient pad at the upper end thereof for engagement of the sacral area of the low back of the user.

10. The combination according to claim 8 wherein said pair of hip restraint means each comprises a plurality of spaced-apart substantially vertically extending bars having a plurality of horizontally extending bars therebetween, said restraint means defining two planes each inclined about 10 degrees inwardly from vertical so as to define converging planes.

11. The combination according to claim 8 wherein said seat means comprises an elongate laterally extending surface having a width sufficient to accommodate the user's buttocks and a depth sufficient to accommodate the user's buttocks.

12. The combination according to claim 8 wherein said strap means comprises an adjustable length belt and buckle.

* * * * *